US010891816B2

(12) United States Patent
Florentino et al.

(10) Patent No.: US 10,891,816 B2
(45) Date of Patent: Jan. 12, 2021

(54) SPATIO-TEMPORAL TOPOLOGY LEARNING FOR DETECTION OF SUSPICIOUS ACCESS BEHAVIOR

(71) Applicant: Carrier Corporation, Palm Beach Gardens, FL (US)

(72) Inventors: Blanca Florentino, Cork (IE); Menouer Boubekeur, Cork (IE); Tarik Hadzic, Cork (IE); Ankit Tiwari, Framingham, MA (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/490,295

(22) PCT Filed: Feb. 28, 2018

(86) PCT No.: PCT/US2018/020219
§ 371 (c)(1),
(2) Date: Aug. 30, 2019

(87) PCT Pub. No.: WO2018/160689
PCT Pub. Date: Sep. 7, 2018

(65) Prior Publication Data

US 2020/0020182 A1 Jan. 16, 2020

Related U.S. Application Data

(60) Provisional application No. 62/465,586, filed on Mar. 1, 2017.

(51) Int. Cl.

| | |
|---|---|
| ***G07C 9/28*** | (2020.01) |
| ***G07C 9/27*** | (2020.01) |
| ***G07C 9/29*** | (2020.01) |

(52) U.S. Cl.
CPC ..... *G07C 9/28* (2020.01); *G07C 9/27* (2020.01); *G07C 9/29* (2020.01); *G07C 2209/08* (2013.01)

(58) Field of Classification Search
CPC ..... G06N 7/005; G06N 20/00; G07C 9/27; G07C 9/37; G07C 9/28; G01C 21/206;
(Continued)

(56) References Cited

U.S. PATENT DOCUMENTS

| | | | |
|---|---|---|---|
| 6,233,588 | B1 | 5/2001 | Marchoili et al. |
| 6,748,343 | B2 | 6/2004 | Alexander et al. |

(Continued)

FOREIGN PATENT DOCUMENTS

| | | | |
|---|---|---|---|
| CN | 104040595 | A | 9/2014 |
| EP | 1646937 | B1 | 6/2011 |

(Continued)

OTHER PUBLICATIONS

Assa Abloy, "Smartair Update on Card", available at: https://www.assaabloyopeningsolutions.nz/Local/NZ/Products/Access%20Control/SMARTair/Update%20on%20Card/PDF/Downloads/SMARTair%20Update%20On%20Card.pdf, accessed Aug. 27, 2019, 7 pages.

(Continued)

*Primary Examiner* — Brian E Miller
(74) *Attorney, Agent, or Firm* — Cantor Colburn LLP

(57) ABSTRACT

A spatio-temporal topology learning system for detection of suspicious access control behavior in a physical access control system (PACS). The spatio-temporal topology learning system including an access pathways learning module configured to determine a set of spatio-temporal properties associated with a resource in the PACS, an inconsistency detection module in operable communication with the access pathways learning module, the inconsistencies detection module configured to analyze a plurality of historical (Continued)

access control events and identify an inconsistency with regard to the set of spatio-temporal properties, and if an inconsistency is detected, at least one of the events is flagged as potentially suspicious access control behavior.

22 Claims, 3 Drawing Sheets

(58) Field of Classification Search
CPC ... G06F 21/604; G06F 21/6218; G06F 21/552
See application file for complete search history.

(56) References Cited

U.S. PATENT DOCUMENTS

| | | | | |
|---|---|---|---|---|
| 7,016,813 | B2 | 3/2006 | Alexander et al. | |
| 7,136,711 | B1 | 11/2006 | Duncan et al. | |
| 7,650,633 | B2 | 1/2010 | Whitson | |
| 7,752,652 | B2 | 7/2010 | Prokupets et al. | |
| 7,818,783 | B2 | 10/2010 | Davis | |
| 7,944,469 | B2 | 5/2011 | Barker | |
| 7,945,670 | B2 | 5/2011 | Nakamura et al. | |
| 8,009,013 | B1 | 8/2011 | Hirschfeld et al. | |
| 8,015,597 | B2 | 9/2011 | Libin et al. | |
| 8,108,914 | B2 * | 1/2012 | Hernoud | G06F 21/71 726/5 |
| 8,160,307 | B2 | 4/2012 | Polcha et al. | |
| 8,166,532 | B2 | 4/2012 | Chowdhury et al. | |
| 8,234,704 | B2 | 7/2012 | Ghai et al. | |
| 8,302,157 | B2 | 10/2012 | Smith | |
| 8,321,461 | B2 | 11/2012 | Hinojosa et al. | |
| 8,370,911 | B1 | 2/2013 | Mallard | |
| 8,464,161 | B2 | 6/2013 | Giles et al. | |
| 8,533,814 | B2 | 9/2013 | Neely | |
| 8,763,069 | B2 | 6/2014 | Renfro et al. | |
| 8,793,790 | B2 | 7/2014 | Khurana et al. | |
| 8,836,470 | B2 | 9/2014 | Pineau et al. | |
| 8,907,763 | B2 | 12/2014 | Pineau et al. | |
| 9,111,088 | B2 | 8/2015 | Ghai et al. | |
| 9,118,656 | B2 | 8/2015 | Ting et al. | |
| 9,189,623 | B1 | 11/2015 | Lin et al. | |
| 9,189,635 | B2 | 11/2015 | Hori et al. | |
| 9,231,962 | B1 | 1/2016 | Yen et al. | |
| 9,237,139 | B2 | 1/2016 | Shaikh | |
| 9,264,449 | B1 | 2/2016 | Roth et al. | |
| 9,311,496 | B1 * | 4/2016 | Dutch | G06F 21/604 |
| 9,400,881 | B2 | 7/2016 | Hernoud et al. | |
| 9,418,236 | B2 | 8/2016 | Cabrera et al. | |
| 10,430,594 | B2 * | 10/2019 | Florentino | G06F 21/604 |
| 2002/0026592 | A1 | 2/2002 | Gavrila et al. | |
| 2002/0162005 | A1 | 10/2002 | Ueda et al. | |
| 2003/0126465 | A1 | 7/2003 | Tassone et al. | |
| 2004/0083394 | A1 | 4/2004 | Brebner et al. | |
| 2004/0153671 | A1 | 8/2004 | Schuyler | |
| 2005/0099288 | A1 * | 5/2005 | Spitz | G06K 17/00 340/506 |
| 2007/0073519 | A1 | 3/2007 | Long | |
| 2007/0272744 | A1 | 11/2007 | Bantwal et al. | |
| 2008/0086758 | A1 | 4/2008 | Chowdhury et al. | |
| 2008/0209506 | A1 | 8/2008 | Ghai et al. | |
| 2010/0023249 | A1 | 1/2010 | Mays et al. | |
| 2011/0148633 | A1 * | 6/2011 | Kohlenberg | G06F 21/30 340/541 |
| 2011/0162058 | A1 | 6/2011 | Powell et al. | |
| 2011/0221565 | A1 | 9/2011 | Ludlow et al. | |
| 2011/0254664 | A1 | 10/2011 | Sadr et al. | |
| 2012/0054826 | A1 | 3/2012 | Asim et al. | |
| 2012/0084843 | A1 | 4/2012 | Hernoud et al. | |
| 2012/0169457 | A1 | 7/2012 | Williamson | |
| 2013/0091539 | A1 * | 4/2013 | Khurana | H04L 63/1425 726/1 |
| 2015/0200925 | A1 | 7/2015 | Lagerstedt et al. | |
| 2015/0220711 | A1 | 8/2015 | Lowe | |
| 2015/0350233 | A1 | 12/2015 | Baxley et al. | |
| 2015/0350902 | A1 * | 12/2015 | Baxley | H04L 63/302 726/7 |
| 2016/0210455 | A1 * | 7/2016 | Lee | G06F 21/552 |
| 2016/0219492 | A1 | 7/2016 | Jung | |
| 2016/0308859 | A1 * | 10/2016 | Barry | G06K 9/2036 |
| 2017/0236347 | A1 * | 8/2017 | Drako | G07C 9/22 340/5.33 |
| 2019/0392657 | A1 * | 12/2019 | Hadzic | G07C 9/22 |
| 2019/0392658 | A1 * | 12/2019 | Hadzik | G07C 9/27 |
| 2020/0020182 | A1 * | 1/2020 | Florentino | G07C 9/29 |
| 2020/0028877 | A1 * | 1/2020 | Tiwari | G07C 9/27 |
| 2020/0074338 | A1 * | 3/2020 | Florentino | G06N 7/005 |

FOREIGN PATENT DOCUMENTS

| | | | |
|---|---|---|---|
| EP | 2348438 | A1 | 7/2011 |
| EP | 2866485 | A1 | 4/2015 |
| EP | 2889812 | A1 | 7/2015 |
| GB | 2493078 | A | 1/2013 |
| JP | 3120555 | U | 4/2006 |
| JP | 2006183398 | A | 7/2006 |
| WO | 0214989 | A2 | 2/2002 |
| WO | 2007089503 | A2 | 8/2007 |
| WO | 2012090189 | A1 | 7/2012 |
| WO | 2013098910 | A1 | 7/2013 |
| WO | 2015065377 | A1 | 5/2015 |
| WO | 2015099607 | A1 | 7/2015 |
| WO | 2016064470 | A1 | 4/2016 |

OTHER PUBLICATIONS

Axiomatics, "Attribute Based Access Control Beyond Roles", available at: https://www.axiomatics.com/blog/attribute-based-access-control-beyond-roles-1/, Aug. 2016, 4 pages.

Biuk-Aghai, Robert P. et al., "Security in Physical Environments: Algorithms and System for Automated Detection of Suspicious Activity", Department of Computer and Information Science, University of Macau, Macau, 2010, 13 pages.

Colantonio, Alessandro, "A Cost-Driven Approach to Role Engineering", In Proceedingsof the 23rd ACM Symposium on Applied Computing, SAC '08, vol. 3, 2008, pp. 2129-2136.

Colantonio, Alessandro, et al., "Mining Stable Roles in RBAC", In Proceedings of the IFIP TC 11 24th International Information Security Conference, SEC '09, 2009, pp. 259-269.

Fitzgerald, William, M., et al., "Anomaly Analysis for Physical Access Control Security Configuration", University College Cork, 2012, 8 pages.

Fong, Simon et al., "A Security Model for Detecting Suspicious Patterns in Physical Environment", Abstract, Third International Symposium on Information Assurance and Security, Aug. 2007, 1 page.

Gupta, Rohit, et al., "Quantitative Evaluation of Approximate Frequent Pattern Mining Algorithms", In Proceedings of the 14th ACM SIGKDD International Conference on Knowledge Discovery and Data Mining, 2008, pp. 301-309.

International Search Report and Written Opinion for application PCT/US2018/018958, dated May 18, 2018, 20 pages.

International Search Report and Written Opinion for application PCT/US2018/020216, dated May 7, 2018, 11 pages.

International Search Report and Written Opinion for application PCT/US2018/020219, dated Jun. 5, 2018, 16 pages.

International Search Report and Written Opinion for application PCT/US2018/18954, dated May 29, 2018, 14pages.

International Search Report for application PCT/US2018/019950, dated Jun. 4, 2018, 15 pages.

Maybury, Mark, "Detecting Malicious Insiders in Military Networks", The MITRE Corporation, 2006, 7 pages.

Metoui, N., et al., "Trust and Risk-Based Access Control for Privacy Preserving Threat Detection Systems", Abstract, International Conference on Future Data and Security Engineering, 2016, 9 pages.

West, Andrew, et al., "Mitigating Spam Using Spatio-Temporal Reputation", University of Pennsylvania, 2010, 22 pages.

(56) References Cited

OTHER PUBLICATIONS

Yan, Pengfan, et al., "Detection of Suspicious Patterns in Secure Physical Environments", Department of Computer and Information Science, Faculty of Science and Technology, University of Macau, Nov. 30, 2006, 6 pages.
Yen, Ting-Fang, et al., "Beehive: Large-Scale Log Analysis for Detecting Suspicious Activity in Enterprise Networks", ACSAC 2013, 10 pages.
Zhang, Dana, et al., "Efficient Graph Based Approach to Large Scale Role Engineering", Transactions on Data Privacy 7 (2014), pp. 1-26.

* cited by examiner

SPATIO-TEMPORAL TOPOLOGY LEARNING FOR DETECTION OF SUSPICIOUS ACCESS BEHAVIOR

TECHNICAL FIELD

The subject matter disclosed herein relates generally to physical access control systems (PACS), and more particularly an access control mapping of a facility to identify spatio-temporal properties of an event to assist in detecting inconsistencies and suspicious access control behavior.

BACKGROUND

Physical access control systems (PACS) prevent unauthorized individuals access to protected areas. Individuals who have a credential (e.g., card, badge, RFID card, FOB, or mobile device) present it at an access point (e.g., swipe a card at a reader) and the PACS makes an almost immediate decision whether to grant them access (e.g., unlock the door). The decision is usually computed at a controller by checking a permissions database to ascertain whether there is a static permission linked to requester's credential. If the permission(s) are correct, the PACS unlocks the door as requested providing the requestor access. Typically, with static permissions, such a request for access can be made at a given time of the day and access will be granted. In standard deployment of a PACS, a permission(s) database is maintained at a central server and relevant parts of the permissions database are downloaded to individual controllers that control the locks at the doors.

When a cardholder swipes a card at a reader, a new record is created in an access event record database, specifying the time of the day, the identity of the cardholder, the identifier of the reader and the response of the system that denies or grants access. The objective of reliable and efficient access control systems is not only to ensure lawful access requests are satisfied, but it is also vital to detect unlawful and suspicious access behavior. Indeed, physical access control systems are facing challenges in detecting and addressing security breaches and violations such as fake cards, cards used by unauthorized persons, or simply misused stolen cards. To address such issues, access controls systems rely on administrator experience and off-line manual audits of access logs to identify potential unlawful/suspicious access events. This type of audit consumes considerable amounts of time and resources. Moreover, manual audits unfortunately, do not guarantee detection of suspicious activities. More importantly, if such suspicious access activities are detected, often, it is too late to address or at least limit the damages of any security breaches.

BRIEF SUMMARY

According to an exemplary embodiment, described herein is A spatio-temporal topology learning system for detection of suspicious access control behavior in a physical access control system (PACS). The spatio-temporal topology learning system including an access pathways learning module configured to determine a set of spatio-temporal properties associated with a resource in the PACS, an inconsistency detection module in operable communication with the access pathways learning module, the inconsistencies detection module configured to analyze a plurality of historical access control events and identify an inconsistency with regard to the set of spatio-temporal properties, and if an inconsistency is detected, at least one of the events is flagged as potentially suspicious access control behavior.

In addition to one or more of the features described above or below, or as an alternative, further embodiments could include that the spatio-temporal properties are based on at least one of a cardholder identity, a resource to which access is desired, the resource associated with a reader and a access point controlling access to the resource, a time zone specifying the time of the day when access to the resource is required, and a history of access events.

In addition to one or more of the features described above or below, or as an alternative, further embodiments could include that the spatio-temporal properties are based on a rule that a first reader can be reached from a second reader if there exists two consecutive access events for any cardholder that accesses the first reader and the second reader.

In addition to one or more of the features described above or below, or as an alternative, further embodiments could include that the spatio-temporal properties include a reachability graph.

In addition to one or more of the features described above or below, or as an alternative, further embodiments could include refining the reachability graph based on an initial estimate of the notional distance between readers determined as the minimum difference between access event time stamps at two connected readers.

In addition to one or more of the features described above or below, or as an alternative, further embodiments could include refining the reachability graph by labeling access pathways based on a profile of at least one cardholder of a plurality of cardholders in the PACS.

In addition to one or more of the features described above or below, or as an alternative, further embodiments could include refining the reachability graph based on at least one of attributes associated with at least one user and an intelligent map of a facility using the PACS to form a refined reachability graph.

In addition to one or more of the features described above or below, or as an alternative, further embodiments could include that the attribute is specific to the user.

In addition to one or more of the features described above or below, or as an alternative, further embodiments could include that the attribute is generic to a group of users.

In addition to one or more of the features described above or below, or as an alternative, further embodiments could include that the attribute is at least one of a user's role, a user's department, a badge type, a badge/card ID.

In addition to one or more of the features described above or below, or as an alternative, further embodiments could include that an inconsistency includes any instance where consecutive events are impossible.

In addition to one or more of the features described above or below, or as an alternative, further embodiments could include that an inconsistency includes a cardholder accessing a first access point at a selected physical distance from a second access point within less than a selected time.

In addition to one or more of the features described above or below, or as an alternative, further embodiments could include that an inconsistency includes a card holder accessing a first access point without also having accessed a second access point in between.

In addition to one or more of the features described above or below, or as an alternative, further embodiments could include that an inconsistency includes a card holder accessing a first access point without also having accessed a second access point in between the first access point and a third access point.

In addition to one or more of the features described above or below, or as an alternative, further embodiments could include that the flagged event is reported and provided with an explanation of a context of the inconsistency.

In addition to one or more of the features described above or below, or as an alternative, further embodiments could include updating a knowledge database of inconsistencies, the knowledge database employed in the identifying an inconsistency.

In addition to one or more of the features described above or below, or as an alternative, further embodiments could include an administrator reviewing the suggested flagged inconsistencies.

Also described herein in an embodiment is a physical access control system (PACS) with spatio-temporal topology learning system for detection of suspicious access control behavior. The physical access control system comprising a credential including user information stored thereon, the credential presented by a user to request access to a resource protected by a access point, a reader in operative communication with the credential and configured to read user information from the credential, a controller executing a set of access control permissions for permitting access of the user to the resource. The PACS also incudes that the permissions are generated with access control request manager based on learning profile based access pathways including, an access pathways learning module configured to determine a set of spatio-temporal properties associated with each resource in the PACS, and an inconsistency detection module in operable communication with the access pathways learning module, the inconsistencies detection module configured to analyze a plurality of historical access control events and identify an inconsistency with regard to the set of spatio-temporal properties and if an inconsistency is detected, at least one of the events is flagged as potentially suspicious access control behavior.

In addition to one or more of the features described above or below, or as an alternative, further embodiments could include that the spatio-temporal properties are based on at least one of a cardholder identity, a resource to which access is desired, the resource associated with a reader and a door controlling access to the resource, a time zone specifying the time of the day when access to the resource is required, and a history of access events.

In addition to one or more of the features described above or below, or as an alternative, further embodiments could include that the spatio-temporal properties are based on a rule that a first reader can be reached from a second reader if there exists two consecutive access events for any cardholder that accesses the first reader and the second reader.

In addition to one or more of the features described above or below, or as an alternative, further embodiments could include that an inconsistency includes any instance where consecutive events are impossible.

Other aspects, features, and techniques of embodiments will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Figure 1:
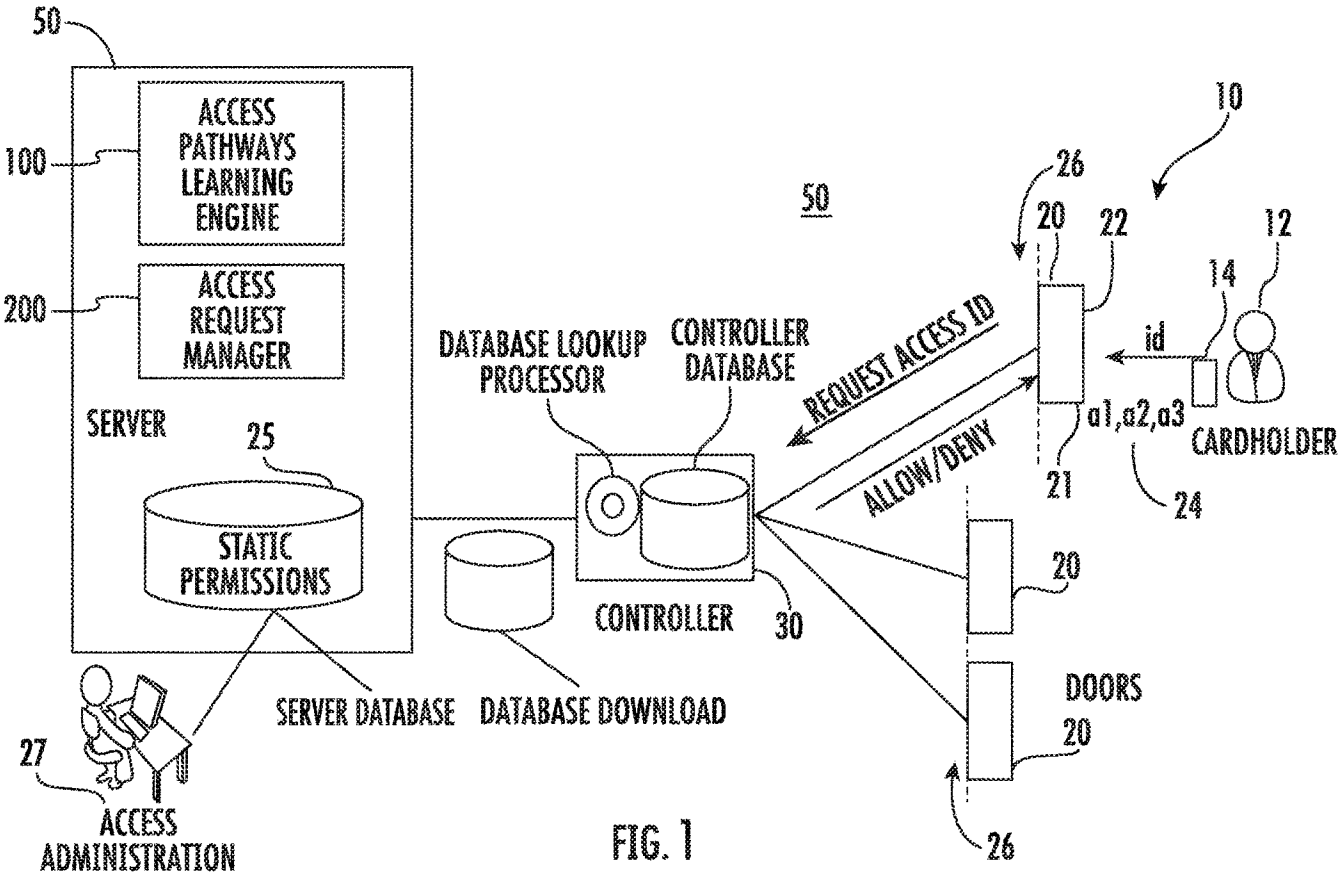
FIG. 1 depicts a standard deployment and operation of a PACS in accordance with an embodiment.

In general, embodiments herein relate to a system and a methodology for detecting suspicious access control behaviors based on inconsistencies and relationships inferred from access history data logs with respect to spatial and temporal properties. In operation, the system analyzes a series of data logs taking into consideration the position/location and the time stamp of access events to detect suspicious activities and flag them to an administrator. In addition, the system provides an explanation of the context of the potential violations to motivate the suggestion of potential unauthorized access control activity. The system in the described embodiments employs an intelligent map of the building and its access control mapping to provide the spatio-temporal properties of an event (location). That is, a map locating the readers, doors and the like, where the access control history logs provide the time stamp of the access events, in particular, those access events that are considered to be unauthorized. The system also employs an intelligent and knowledge-based engine or process that analyzes properties, events locations and times, to detect inconsistencies and therefore flag suspicious access control behaviors.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended. The following description is merely illustrative in nature and is not intended to limit the present disclosure, its application or uses. It should be understood that throughout the drawings, corresponding reference numerals indicate like or corresponding parts and features. As used herein, the term controller refers to processing circuitry that may include an application specific integrated circuit (ASIC), an electronic circuit, an electronic processor (shared, dedicated, or group) and memory that executes one or more software or firmware programs, a combinational logic circuit, and/or other suitable interfaces and components that provide the described functionality.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in Figure X may be labeled "Xa" and a similar feature in Figure Z may be labeled "Za."

Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 depicts a deployment and operation of a PACS 10. In the figure, a user 12 with a credential 14 (e.g., cardholder) arrives at a reader 22 at a given access point with a lock 21 (e.g., locked door 20, gate, etc.) controlling access to a protected space also called a resource 26. The user 12 presents the credential 14 (e.g., badge, FOB, or mobile device) which is read by the reader 22 and identification information stored on the credential 14 is accessed and transmitted to a local controller 30. The controller 30 compares the identification information from the credential 14 with a permissions database 25 on the controller 30 to ascertain whether there is a permission 25 linked to user's credential 14. If the permission(s) 25 are correct, i.e., there is a match, and the particular credential 14 has authorization to access the protected space 26, the controller 30 then sends a command to the door controller or lock 21 to unlock the door 20 as requested providing the user or requestor 12 access. The controller 30 in this instance, makes an almost immediate decision whether to grant the access (e.g., unlock the door). Users 12 also expect a rapid response, waiting at the access point of access decisions would be very undesirable and wasteful. In a conventional deployment of a PACS 10, a set of static permission(s) database 25 is maintained at a central server 50. To ensure rapid response when queried, relevant parts of the permissions 25 database are downloaded to individual controllers 30 that control the locks 21 at the doors 20.

In many PACS, such as the access control system 10 shown in FIG. 1, neither the card readers 22 nor the credentials 14 e.g., access cards have any appreciable processing, power, or memory themselves. Hence, such card readers 22 and access cards 14 are usually referred to as passive devices. By contrast, the centralized controller 30 and server 50 of the access control system 10 is usually a well-designed and sophisticated device with fail-operational capabilities and advanced hardware and algorithms to perform fast decision making. Moreover, the decision making process of the centralized controller 30 is fundamentally based on performing a lookup in of the static permissions 25. The static permissions 25 contains static policy based rules, (e.g., one rule might provide that user 12 is not allowed entry into a given room 26), which change only when the policy changes (e.g., the static permissions 25 might be changed to provide that user 12 can henceforth enjoy the privileges of a given room 26). Policies are implemented in a set of rules that governs authorization. The static policies as mentioned above can be viewed as context-independent policies 135 and rules. In contrast, context-sensitive policies 135 will require a dynamic evaluation of different states of the PACS 10, building system parameters, other building systems, and external criteria, maybe even including the user's past history of activities. This evaluation is referred to as dynamic authorization.

With such an interconnect architecture of depicted in FIG. 1 and with a reasonable number of users 12 of a protected facility, the PACS 10 using static permissions 25 makes decisions quickly, is reliable, and is considered to be reasonably robust. However, as buildings expand and enterprises expand, the use of the static permissions 25 in a database can grow and become unwieldy and the potential for unauthorized access events increases. Furthermore, it is expected that buildings and facilities of the future will require increasingly more intelligent physical access control solutions. For example, access control solutions are being provided with the capability to detect such conditions as intrusion and fire. In general, this increased capability implies that such access control solutions should be provided with the ability to specify conditions that are dynamically evaluated, e.g., disable entry to a particular room 26 in case of a break-in, and/or disable entry to a particular room 26 if its occupancy reaches its capacity limit, and/or allow entry to a normal user 12 only if a supervisor is already present inside the room 26, etc. This increased capability leads to a significant emphasis on the need not only for more dynamic means for requesting and assigning permissions 25 to users 12, but also a more dynamic scheme for detecting suspicious access behavior. Such a dynamic scheme can be centrally implemented with an architecture that learns information within PACS 10 to facilitate or automate future tasks including audits of access control behaviors to address and minimize the ramifications of security and access control breaches.

Figure 2:
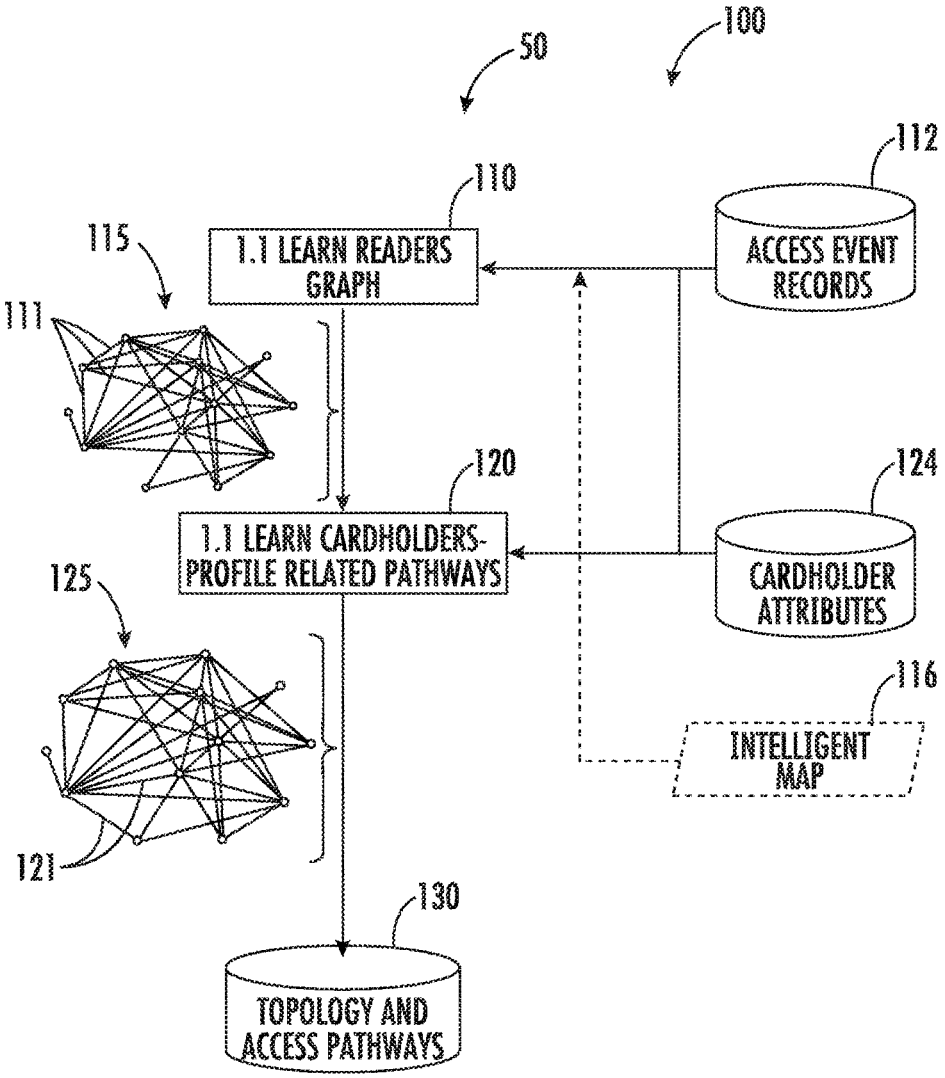
FIG. 2 depicts a flow diagram for an Access Pathways Learning Engine in accordance with an embodiment.

Turning now to FIG. 2 as well, FIG. 2 depicts a flow diagram for a Topology Learning module 100. In an embodiment, the Topology Learning (TLM) 100 is a process that can run independently of the operation of the PACS 10 and learns offline or online in background the reader's 22 (or access points/doors 20) reachability graph 115. The TLM 100 is a process operating on server (shown generally as 50 in FIG. 2), which may be centrally located or cloud based. The TLM 100 could also be a process operating on one or more controllers 30 in the PACS 10.

At process step 110 the reader's 22 reachability graph 115 is a connectability matrix of the accessible pathways between readers 22 or access points 20 in the PACS 10. The reachability graph 115 of a given facility or building is inferred based on historical event records 112 saved in the server 50 of the user's 12 accesses at all readers 22 and doors 20. The reachability graph 115 is compiled employing a rule that a pathway 111 can be defined given reader 22 X (Rx) can be reached from and other reader 22 Y (Ry), if there exists two consecutive access events for any cardholder 12 that accesses Ry and Rx. Of course, it will be appreciated that any variety of rules could be employed for establishing pathways 111 and the reachability graph 115, including a more conservative rule requiring more than multiple consecutive access events as a positive indication that a reader 22 can be reached from another reader 22. In addition, the reachability graph 115 may also to capture information about distance among readers 22. This may be accomplished based on an analysis of the time difference between two consecutive access events from the historical access events records. Moreover, the TLM learns the reachability graph 115 and estimates distance among readers 22 based on access events. In an embodiment, the minimum difference between access event time stamps at two connected readers 22 may be used to obtain an initial estimate of the notional distance between readers 22. Once initial estimates for one-to-one reader distances are obtained, conventional techniques such as trilateration or triangulation may be employed at the building level to correct distance estimates and obtain additional information on the relative location of one reader 22 to another reader 22.

If an intelligent map 116 of the facility for the PACS 10 is available, the reachability graph 115 may be readily refined using topological information from the map 116. For example, when an intelligent map is available; the map is processed to extract information about rooms/areas protected by the readers 22, proximity (neighborhood), reachability, and distances.

Figure 3:
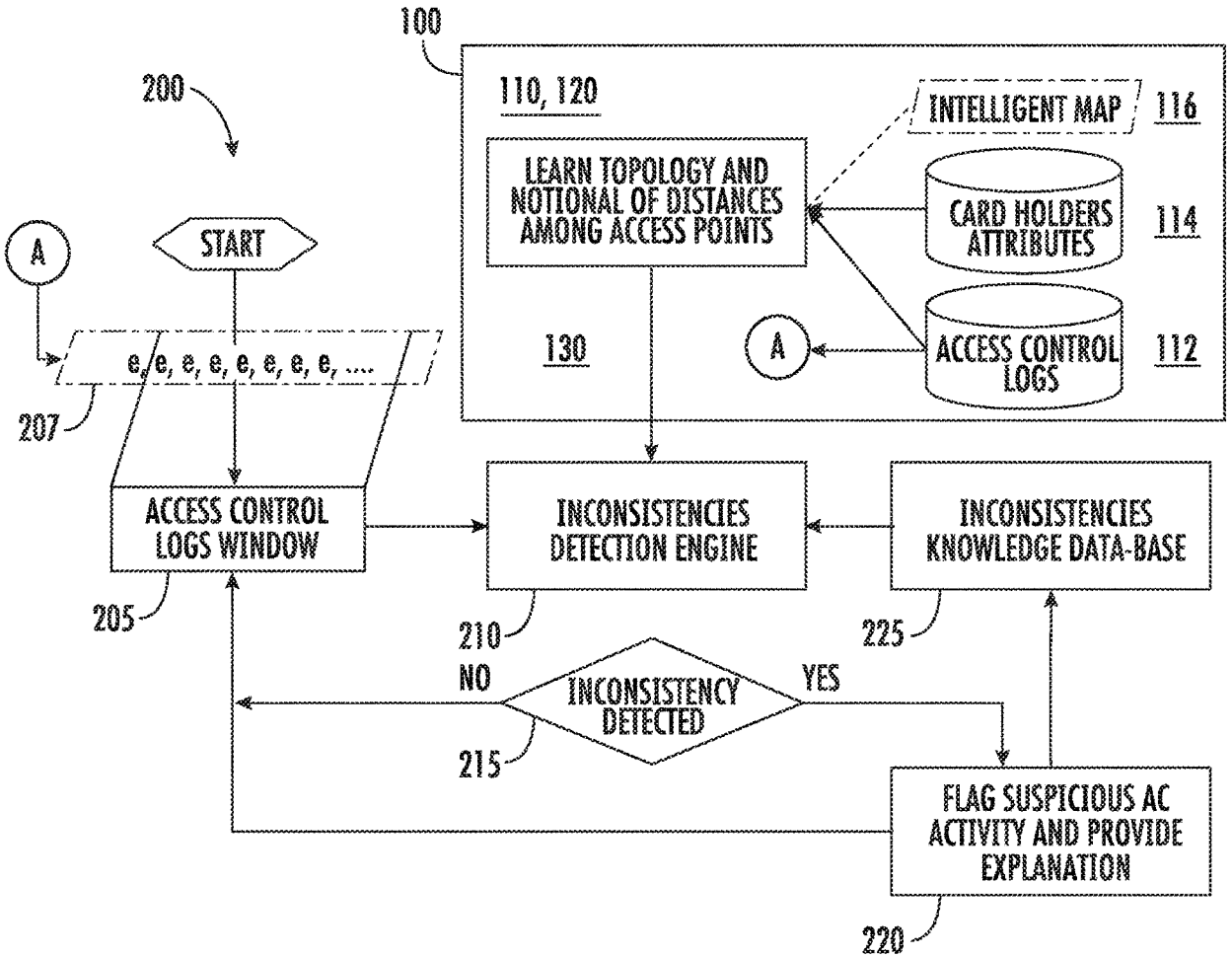
FIG. 3 depicts a flow diagram of a process for a Supposition Behavior Detection system based on spatio-temporal properties in accordance with an embodiment.

Once the reachability graph 115 had been established, at process step 120 the reader reachability graph 115 and historical event records of cardholders with a specific profile (set of attributes 114) are used to compute the profile-based access pathways 121 (list of connected readers 22) that cardholders 12 with specific profile traverse from any entry reader 22 (readers giving access to facilities) to every other reader 22. The profile-based access pathways 123 are learned also from the access event database 112 with (only events from cardholders 12 with a specific profile/attributes 114) with the same rule(s) as the reachability graph 115 but considering also a sequence of events. As an example, if in the events records 112, a cardholder' access record includes the following consecutive access readers 22 "Re, R1, R3,R5, R3,R4" being Re an entry reader 22 the access pathways 123 will be {Re, R1} to R1, {Re,R1,R3} to R3, and {Re,R1, R3,R5} to R5 and {Re,R1,R3,R4} to R4. The reachability graph 115 is used to check that the direct/simple pathways 111, 121 really exist between readers 22 Re-R1, R1-R3, R3-R4 and R3-R5. When analyzing all the cardholders 12 for a specific profile, each access pathway 123 will have its corresponding frequency based on the number of time this access pathways 123 was seen in the access event database 112. Readers reachability graph and profile-based access pathways 123 as depicted at 125 are updated regularly based on new access events as the PACS 10 is used. The reachability graph and profile-based access pathways 125 is saved in the server 50 as depicted at 130 for use in managing permissions 25 requests as described herein. FIG. 3 depicts a flow diagram of a process for topology learning and suspicious behavior analysis 200. In an embodiment, the process 200 can run independently of the operation of the PACS 10 and includes the Topology Learning Module (TLM) 100 described above with respect to FIG. 2. The process initiates at step 205 with a consideration of a historical group of access events 112 log window composed of a sequence of access control events 207, where each event "e" 207 includes at least a Cardholder ID ($C_{ID}$) (an attribute 124) having requested access to a Door $D_j$ 20 at time $T_y$ and if access was granted or not. In addition, each event 207 may include additional data and metadata regarding the user 12 associated with the event. The data may include the cardholder attributes 124 (e.g. Cardholder's title, departments or badge type) resource attribute (e.g. export control, location, type (Lab, office)). An inconsistency checking module includes a processing engine 210 that analyzes the event data 207 and searches for inconsistencies with regard to spatio-temporal properties, e.g., the reachability graph 115 and profile based access pathways 125, 130 provided by the TLM 100 and user attributes 124. In general an inconsistency is highlighted/triggered 1) when a violation of a logical behavior (e.g. two swipes of the same card cannot take place in doors that are far apart), 2) when a suspicious behavior is detected (e.g. successive denied access in neighboring doors), or whenever a pattern (sequence of timed requests of access through a particular path) is detected that is defined by security manager as risky/suspicious. For example, in a simple case, one inconsistency would be that a card holder 12 cannot access two doors 20 that are far apart in physical distance within a short time frame. Another example would be that a card holder 12 cannot access two doors 20 without also having requested access by presenting a card or credential 14 at another reader 22 and door 20 in between. If an inconsistency is detected as depicted at 215, the process 200 moves to 220 and provides an explanation describing the spatio-temporal properties that have been violated. If not, the process returns to continue reviewing the access control events 207 at process step 205. Finally at 225 an inconsistency knowledge data base is maintained and updated with the inconsistency identified.

Continuing with FIG. 3, the inconsistency knowledge data-base 225 is a set of rules describing spatio-temporal inconsistencies. In one embodiment, the inconsistency knowledge data-base 225 is initially generated from the intelligent map 116, or extracted from the learned topology spatio-temporal properties e.g., the reachability graph and profile based access pathways 125, 130 provided by the TLM 100. In operation, the database 225 is updated on real time basis through the inconsistency detection engine 210. Alternatively, in another embodiment database could also be populated as a consistency knowledge database that contains a set of rules describing the spatial, temporal, and user attribute 124 properties that are employed for one or more events. In other words, a consistency database could also be formulated based on acceptable spatial, temporal, and user attribute 124 data. In this case, the inconsistency engine 210 can look for deviations from the consistency database.

The spatio-temporal, user attribute 124 properties amassed in the inconsistency database 225 may also be employed to ensure/enforce policies. For example, in one embodiment an "Escort Policy"—That is, ensure a visitor card presented at a reader 22 with attribute 124 export control=Yes, is either preceded by or followed by an escort employee card being presented at that reader 22 within a certain temporal, spatial constraint. Another example of policy enforcement that could be employed would be a "No loitering zone"—that is, to ensure consecutive credential presentations at the given entry reader 22 and exit reader 22 of a specified "no loitering zone" occur within a specified or expected time.

Advantageously the described embodiments will provide new capabilities to physical access controls systems by 1) enabling "near" real-time detection of suspicious access control behaviors through analysis of spatio-temporal of inconsistencies in access events, 2) enabling forensics capabilities to trace specious behaviors and provide evidence of security breaches 3) supporting auditing and access control logs analysis, specific to certain categories of violation, e.g., borrowing access card to unauthorized user 12. Moreover, the described embodiments automate part of the administrative processes for an enterprise and that has heretofore been limited to skilled administrative 27 functions.

The terminology used herein is for the purpose of describing particular embodiments only and is not intended to be limiting. While the description has been presented for purposes of illustration and description, it is not intended to be exhaustive or limited to the form disclosed. Many modifications, variations, alterations, substitutions, or equivalent arrangement not hereto described will be apparent to those of ordinary skill in the art without departing from the scope of the disclosure. Additionally, while the various embodiments have been described, it is to be understood that aspects may include only some of the described embodiments. Accordingly, embodiments are not to be seen as being limited by the foregoing description, but is only limited by the scope of the appended claims.

The invention claimed is:

1. A spatio-temporal topology learning system for detection of suspicious access control behavior in a physical access control system (PACS), the spatio-temporal topology learning system comprising:

an access pathways learning module configured to determine a set of spatio-temporal properties associated with a resource in the PACS;

an inconsistency detection module in operable communication with the access pathways learning module, the inconsistencies detection module configured to analyze a plurality of historical access control events and identify an inconsistency with regard to the set of spatio-temporal properties; and if an inconsistency is detected, at least one of the events is flagged as potentially suspicious access control behavior;

wherein the spatio-temporal properties include a reachability graph;

wherein the spatio-temporal topology learning system refines the reachability graph based on an initial estimate of the notional distance between readers determined as the minimum difference between access event time stamps at two connected readers;

the inconsistency detection module detecting the inconsistency in response to the refined reachability graph.

2. The spatio-temporal topology learning system of claim 1 wherein the spatio-temporal properties are based on at least one of a cardholder identity, a resource to which access is desired, the resource associated with a reader and a door controlling access to the resource, a time zone specifying the time of the day when access to the resource is required, and a history of access events.

3. The spatio-temporal topology learning system of claim 2 wherein the spatio-temporal properties are based on a rule that a first reader can be reached from a second reader if there exists two consecutive access events for any cardholder that accesses the first reader and the second reader.

4. The spatio-temporal topology learning system of claim 1 further including further refining the reachability graph by labeling access pathways based on a profile of at least one cardholder of a plurality of cardholders in the PACS.

5. The spatio-temporal topology learning system of claim 1 further including further refining the reachability graph based on at least one of attributes associated with at least one user and an intelligent map of a facility using the PACS to form the refined reachability graph.

6. The spatio-temporal topology learning system of claim 5 wherein the attribute is specific to the user.

7. The spatio-temporal topology learning system of claim 5 wherein the attribute is generic to a group of users.

8. The spatio-temporal topology learning system of claim 5 wherein the attribute is at least one of a user's role, a user's department, a badge type, a badge/card ID.

9. The spatio-temporal topology learning system of claim 1 wherein an inconsistency includes any instance where consecutive events are impossible.

10. The spatio-temporal topology learning system of claim 1 wherein an inconsistency includes a cardholder accessing a first door at a selected physical distance from a second door within less than a selected time.

11. The spatio-temporal topology learning system of claim 1 wherein an inconsistency includes a card holder accessing a first door without also having accessed a second door in between.

12. The spatio-temporal topology learning system of claim 1 wherein an inconsistency includes a card holder accessing a first door without also having accessed a second door in between the first door and a third door.

13. The spatio-temporal topology learning system of claim 1 wherein the flagged event is reported and provided with an explanation of a context of the inconsistency.

14. The spatio-temporal topology learning system of claim 1 further including updating a knowledge database of inconsistencies, the knowledge database employed in the identifying an inconsistency.

15. The spatio-temporal topology learning system of claim 1 further including an administrator reviewing the suggested flagged inconsistencies.

16. A physical access control system (PACS) with spatio-temporal topology learning system for detection of suspicious access control behavior, the physical access control system comprising:

a credential including user information stored thereon, the credential presented by a user to request access to a resource protected by a door;

a reader in operative communication with the credential and configured to read user information from the credential;

a controller executing a set of access control permissions for permitting access of the user to the resource, the permissions generated with access control request manager based on learning profile based access pathways comprising:

an access pathways learning module configured to determine a set of spatio-temporal properties associated with each resource in the PACS;

an inconsistency detection module in operable communication with the access pathways learning module, the inconsistencies detection module configured to:

analyze a plurality of historical access control events and identify an inconsistency with regard to the set of spatio-temporal properties;

if an inconsistency is detected, at least one of the events is flagged as potentially suspicious access control behavior; and wherein the controller is disposed at an access point to permit access to the resource;

wherein the spatio-temporal properties include a reachability graph;

wherein the spatio-temporal topology learning system refines the reachability graph based on an initial estimate of the notional distance between readers determined as the minimum difference between access event time stamps at two connected readers;

the inconsistency detection module detecting the inconsistency in response to the refined reachability graph.

17. The physical access control system of claim 16 wherein the spatio-temporal properties are based on at least one of a cardholder identity, a resource to which access is desired, the resource associated with a reader and a door controlling access to the resource, a time zone specifying the time of the day when access to the resource is required, and a history of access events.

18. The physical access control system of claim 16 wherein the spatio-temporal properties are based on a rule that a first reader can be reached from a second reader if there exists two consecutive access events for any cardholder that accesses the first reader and the second reader.

19. The physical access control system of claim 16 wherein an inconsistency includes any instance where consecutive events are impossible.

20. The physical access control system of claim 16 wherein an inconsistency includes a car holder accessing a first access point at a selected physical distance from a second access point within less than a selected time.

21. The physical access control system of claim 16 wherein an inconsistency includes a card holder accessing a first access point without also having accessed a second access point in between.

22. The physical access control system of claim 16 wherein an inconsistency includes a card holder accessing a first access point without also having accessed a second access point in between the first door and a third access point.

* * * * *